US005306157A

United States Patent [19]

Francisco

[11] Patent Number: 5,306,157

[45] Date of Patent: Apr. 26, 1994

[54] ADJUSTABLE DUPLEX RECEPTACLE

[76] Inventor: Thomas E. Francisco, 446 Niagara Falls Blvd., Kenmore, N.Y. 14223

[21] Appl. No.: 898,812

[22] Filed: Jun. 15, 1992

[51] Int. Cl.[5] ..... H01R 29/00

[52] U.S. Cl. ..... 439/52; 200/51.03; 200/51.05

[58] Field of Search ..... 439/52, 188, 189; 200/51 R, 51.02-51.08

[56] References Cited

U.S. PATENT DOCUMENTS

| | | | |
|---|---|---|---|
| 1,393,822 | 10/1921 | Parker | 439/189 |
| 1,669,784 | 5/1928 | Scofield | 200/51.03 |
| 3,596,019 | 9/1971 | Koester | 200/51.09 |
| 3,852,703 | 12/1974 | Carney et al. | 439/188 |
| 4,460,811 | 7/1984 | Murr et al. | 200/51.03 |
| 5,098,307 | 3/1992 | Francisco | 439/189 |

*Primary Examiner*—Neil Abrams
*Attorney, Agent, or Firm*—Howard J. Greenwald

[57] ABSTRACT

An adjustable, duplex receptacle containing two female receptacles and three separate electrical contacts. The first such electrical contact contains a first terminal, a first terminal screw, and a first contact plate. The second such electrical contact contains a second terminal, a second terminal screw, and a second contact plate. The third such contact contains a third terminal and a movable contact assembly. By means of a simple manual adjustment, one may change the wiring of the receptacle of this invention so that one of its outlets is converted from direct contact with a constantly hot, positive line to electrical contact with either an external switch or a secondary source of power.

8 Claims, 7 Drawing Sheets

ADJUSTABLE DUPLEX RECEPTACLE

FIELD OF THE INVENTION

An electrical receptacle which, by the use of a manual switch, can be converted from one mode of operation to another.

BACKGROUND OF THE INVENTION

The prior art has recognized that, in many electrical installations, it is sometimes desirable that a given electrical outlet (or a group of outlets) be connected to an electrical power supply through a switch located away from the outlet(s). The art also recognizes that, at other times, it is desirable for the outlet(s) to be directly connected to electrical power without being subjected to control by a remote switch.

In applicant's U.S. Pat. No. 5,098,307, there is disclosed an adjustable duplex receptacle which contains four bus bars. One of the bus bars is attached to a spring-loaded leg which, with the use of an adjustable, rotatable pin, can be used to contact either of two of the other bus bars.

The receptacle of U.S. Pat. No. 5,098,307 is not readily adjustable; the pin cannot easily be rotated by hand, and often must be moved with the use of a tool such as, e.g., a screwdriver. The use of such a tool with a live receptacle often creates a danger of electrical shock.

Furthermore, the receptacle of U.S. Pat. No. 5,098,307 utilizes flexible contacts which, after repeated use, will often tend to make poorer contact.

It is an object of this invention to provide an adjustable duplex receptacle comprised of two plugs which is so configured that both of the plugs may be connected to a constant power source or, alternatively, one of the plugs may be connected through an external switch to a constant power source.

It is another object of this invention to provide a simple, inexpensive adjustable duplex receptacle which can readily be changed by manual means so that the electrical connections of at least one of its plugs can be varied.

It is yet another object of this invention to provide an adjustable duplex receptacle which can be more readily adjusted manually than the receptacle of U.S. Pat. No. 5,098,307.

It is yet another object of this invention to provide an adjustable duplex receptacle which does not utilize the flexible contact plates of U.S. Pat. No. 5,098,307.

SUMMARY OF THE INVENTION

In accordance with this invention, there is provided an adjustable duplex receptacle which is comprised of at least a first bus bar, a second bus bar, and a third bus bar. The third bus bar is operatively connected to a movable plate which can be moved between a first position (in which contacts one of the first two bus bars) and a second position (in which it contacts the others of said bus bars).

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

The duplex receptacles 10 of U.S. Pat. No. 5,098,307 is similar in some respects to applicant's duplex receptacle. The disclosure of this United States patent is hereby incorporated by reference into this specification.

Figure 1:
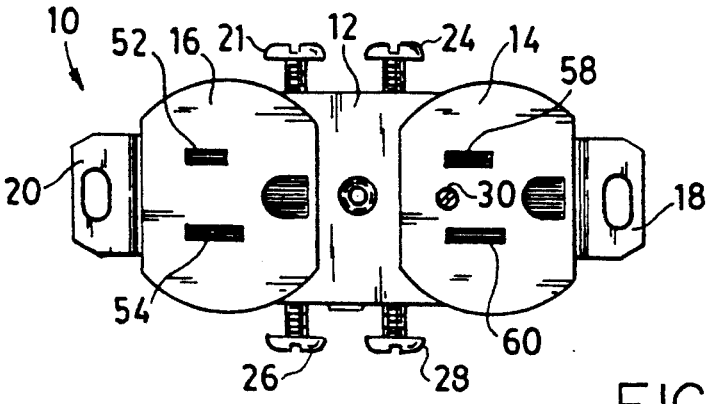
FIG. 1 is a top-view of the of the duplex receptacle of U.S. Pat. No. 5,098,307.

FIG. 1 illustrates the prior duplex receptacle. Referring to FIG. 1, the duplex outlet 10 is comprised of a body (or housing) 12 suitably recessed to receive to plug in female receptacles 14 and 16, respectively. Each of the receptacles 14 and 16 is preferably provided with a grounding plate 18 and 20, respectively. Electrical connections may be made to duplex receptacle 10 by means of connecting terminal screws 22, 24, 26, and 28. In the embodiment shown in FIG. 1, terminal screws 22, 24, 26, and 28 are not spring loaded.

Extending upwardly from the cavity of the receptacle 10 to the surface of body 12 of the duplex outlet 10 is an adjustment pin 30, which preferably is at least partially nonconductive. This pin 30 also extends downwardly into the inner cavity (not shown in FIG. 1) of receptacle 10 and allows one to manually change the connections made within receptacle 10.

Figure 2:
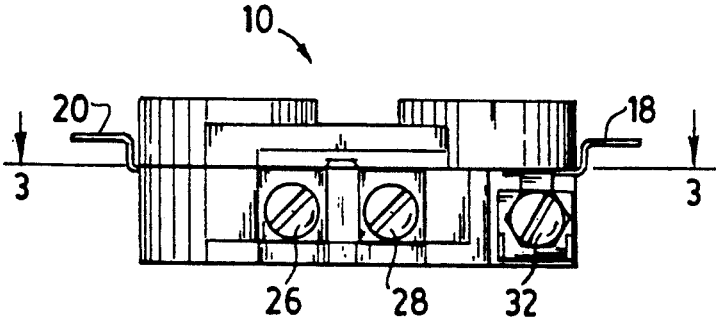
FIG. 2 is a side view of the embodiment of FIG. 1.

FIG. 2 is a side view of the receptacle depicted in FIG. 1 Referring to FIG. 2, it will be seen that this preferred receptacle is comprised of a grounding screw 32 which is electrically connected to (and is part of) grounding plate 18. Although not shown in FIG. 2, it is preferred that grounding plates 18 and 20 be an integral body. Thus, the connection of grounding screw 32 to plate 18 also acts to ground plate 20.

Figure 3:
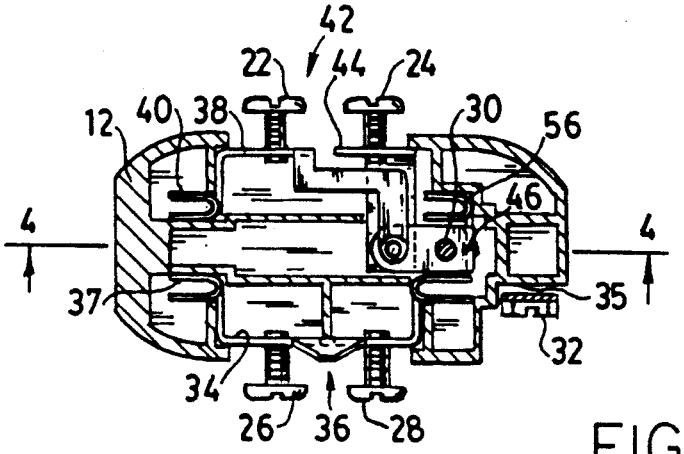
FIG. 3 an exposed, top view of the embodiment of FIG. 1, showing the components of the duplex receptacle of said Figure.

Referring to FIG. 3, it will be seen that the preferred duplex receptacle 10 is comprised of a multiplicity of separate bus conductors, at least three of which are connected to one or more separate terminal screws.

Terminal screws 26 and 28 are connected to bus conductor 34, which in turn is connected to terminals 35 and 37. Because these connecting terminal screws 26 and 28 are directly connected by bus conductor 34, and because the bus conductor 34 is, in turn, directly connected to the negative side of the electrical power supply, then the left side 36 of receptacle 10 is the neutral side.

Bus conductors are well known to those skilled in the electrical art and are described, e.g., in the Leviton Wiring Device Catalog D-300 (Leviton Manufacturing Company, Inc., Little Neck, New York 11362, 1990). As used in this specification, the term "bus conductor" refers to an integral, conductive member which is electrically connected to either a terminal and/or another bus conductor.

Referring again to FIG. 3, it will be seen that terminal screw 22 is electrically connected to bus conductor 38 which, in turn, is connected to terminal 40. Because bus conductor 38 is directly connected to the positive side of the electrical power supply, then the section 42 of receptacle 10 is the "constant hot" section of the positive side.

Referring again to FIG. 3, terminal screw 24 is connected to bus conductor 44. As will be discussed later in this specification, bus conductor 44 is preferably not connected to any terminal, but it may be connected to an external switch or a secondary power source.

Figure 4:
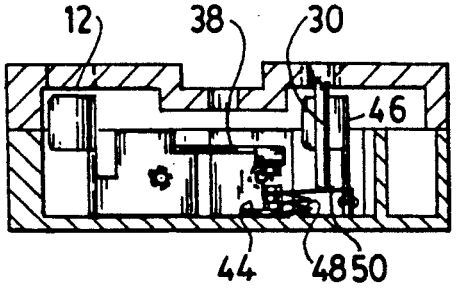
FIG. 4 is an exposed, side view of the embodiment of FIG. 1.

It will also be seen from FIG. 3 that the outlet 10 also comprises conductor bus 46. FIG. 4 is a cutaway side view of the embodiment of FIG. 1. Referring to FIG. 4, it will seen that, when pin 30 is depressed against spring 48, plate 50 makes contact with bus conductor 44. When, however, the pressure on pin 30 is released, spring 48 urges the pin upwardly so that plate 50 makes contact with conductor bus 38.

Figure 5:
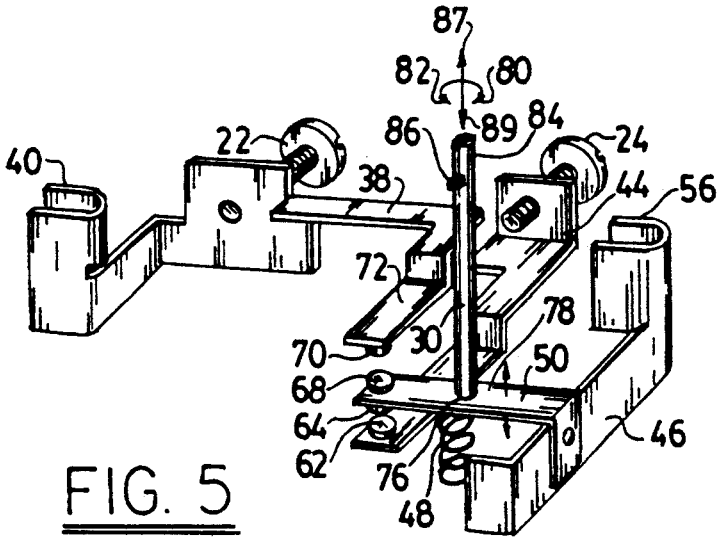
FIG. 5 is a perspective view of the bus bars and the pin used in the embodiment of FIG. 1.

FIG. 5 illustrates the operation of the receptacle 10. Terminal 40 is accessible through orifice 52 of receptacle 10 (see FIG. 1). Orifice 54 of receptacle 10 communicates with the neutral terminal 37 of conductor bus 34 (see FIG. 3). Terminal 56 of conductor bus 46 (see FIG. 5) is accessible through orifice 58 of receptacle 10 (see FIG. 1). Orifice 60 of receptacle 10 communicates with the neutral terminal 35 of conductor bus 34.

Referring again to FIG. 5, it will be seen that, when rod 30 is pushed down, spring-loaded contact 50 makes contact with contact 62 of conductor bus 44. When such contact is made, current flows from the positive side of the power supply (not shown) through terminal screw 24, through conductor bar 44, through contact 62, through plate contact 64 of plate 50, through conductor bus 46, and to terminal 56. In this case, terminal 35 is connected to neutral, and terminal 56 through terminal screw 24 to either an external switch (not shown) or a secondary power source (not shown). In this case, thus, the external switch may be used to turn power to the right plug off and on. Alternatively, a secondary power supply may be used to supply power to the circuit.

When, on the other hand, rod 30 is allowed to be pushed upwardly by the action of spring 48, contact is made between contact 68 of plate 50 of conductor bus 46, and contact 70 of plate 72 of conductor bus 38. In this case, terminal 35 is still connected to neutral, and terminal 56 is electrically connected to terminal screw 22. In this case, the terminal 56 is directly connected to the direct hot power supply.

Thus, it will be seen that, when rod 30 is not pressed down, both the right plug 14 and the left plug 12 are directly connected to the direct hot power supply. However, when rod 30 is depressed, although the left plug 12 remains directly connected to the direct hot power supply, the right plug 14 now is connected to either the external switch or the secondary power source.

The receptacle 10 is provided with an integral, unitary means for manually locking the right plug 14 into a position where it is either directly connected to the direct hot power supply or, alternatively, connected to the external switch and/or the secondary power source. This locking means is comprised of rotatable, nonconductive pin 30.

Pin 30 is preferably contiguous with and rotatably mounted on plate 50 (see FIG. 5). In the preferred embodiment, the bottom surface 76 of pin 30 is contiguous with the top surface 78 of plate 50, and the pin is free to rotate in the directions of arrows 80 or 82. Any means of rotatably mounting pin 30 on plate 50 may be used. Thus, e.g., pin 30 may be allowed to sit on plate 30. Thus, e.g., a hole (not shown) may be provided in plate 50 through which a projection extending downwardly from surfaced 76 of pin 30 may extend. Other conventional means of rotatably mounting pin 30 on plate 50 may be used.

Pin 30 is preferably nonconductive. At least the portion 76 which contacts plate 50 does not conduct electricity. At least such portion (and preferably the entire pin 30) consists essentially of a nonconductor such as, e.g., fiberglass.

Integrally formed on the upper portion 84 of pin 30 is a horizontally-extending latch 86.

In one preferred embodiment illustrated in the figures, the body 12 of receptacle 10 is comprised of an orifice 88 through which pin 30 extends. The inner surface 90 of body 12 is also provided with a cammed surface 92 which latch 86 of pin 30 follows. When pin 30 is turned in the direction of arrow 82 (see FIG. 5), the latch 86 is allowed to ride to its up position 94, pin 30 thus rises, and contact is made between plates 50 and 72. When pin 30 is turned in the direction of arrow 80 (see FIG. 5), the latch is caused to move to its down position 96, pin 30 is depressed, and contact is made between plate 50 and conductive bus 44.

Latch 86 of rod 30 provides a means for locking pin 30 in its down position. Once the rod 30 is locked in the down position, no reasonable amount of force in the directions of arrows 87 and/or 89 will cause it to move to its up position; only the movement of rod 30 in the direction of arrow 82 will unlock the rod.

The locking feature of outlet 10 prevents it from accidentally changing its connections because of accidental contact, the careless pulling of a plug, or wear.

Figure 6:
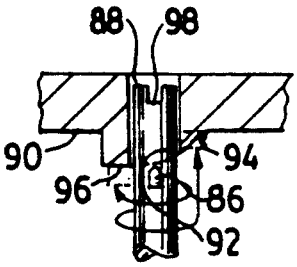
FIGS. 6 and 7 illustrate one preferred locking mechanism for the pin depicted in FIG. 5.

In the preferred embodiment illustrated in FIG. 6, pin 30 is provided with a screw slot which will facilitate rotation of pin 30 is either a clockwise or counterclockwise direction.

Figure 7:
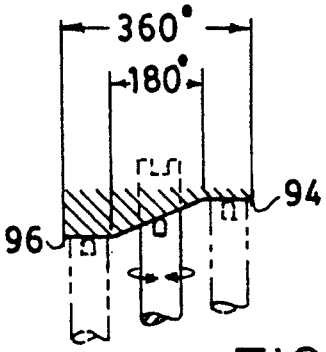

FIG. 7 also illustrates how the rotation of pin 30 can move the cam from one position to another.

Figure 8:
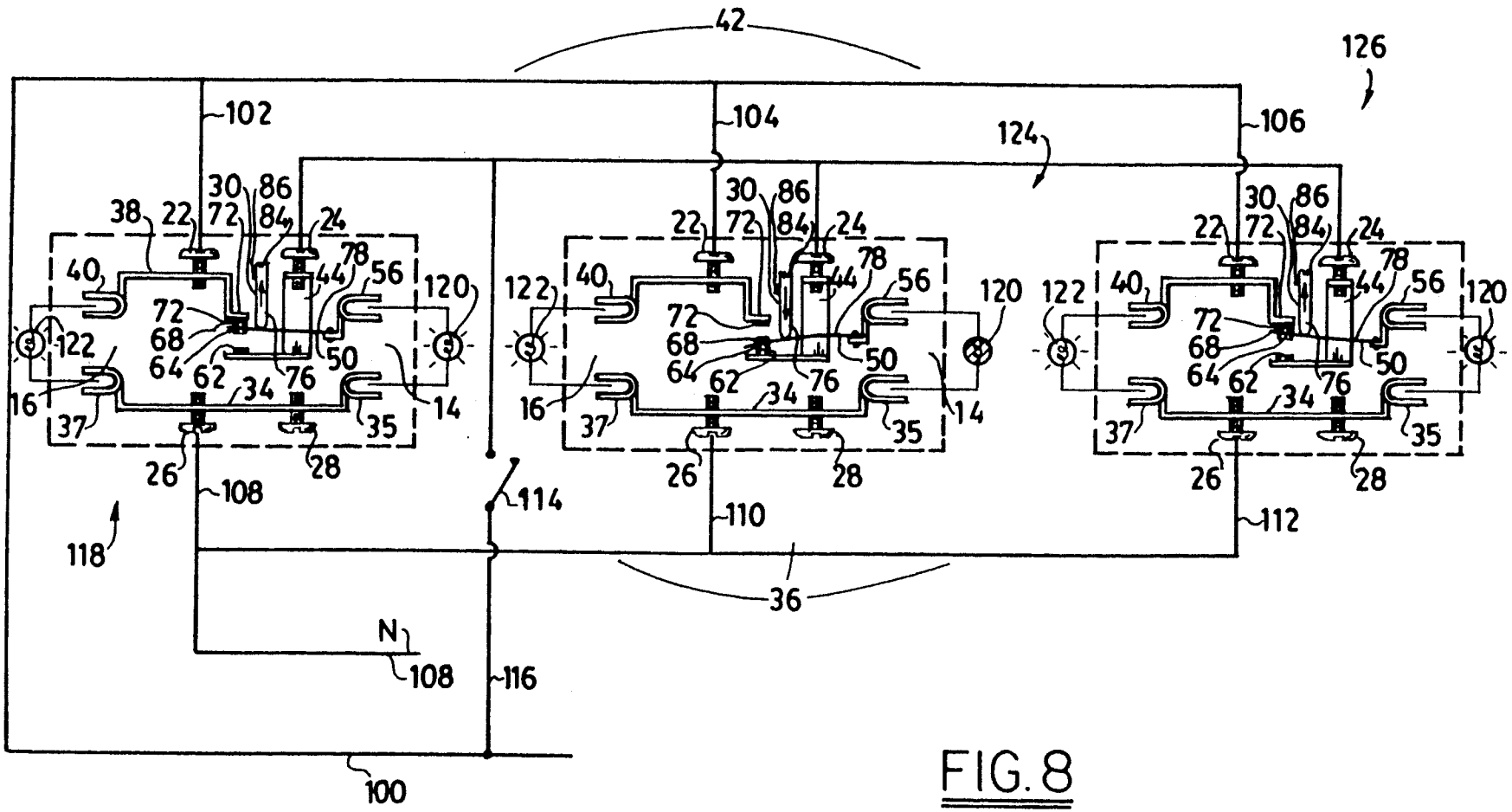
FIGS. 8 and 9 are wiring diagrams illustrating the use of the embodiment of FIG. 1 in changing the connections of its duplex plugs.
Figure 9:
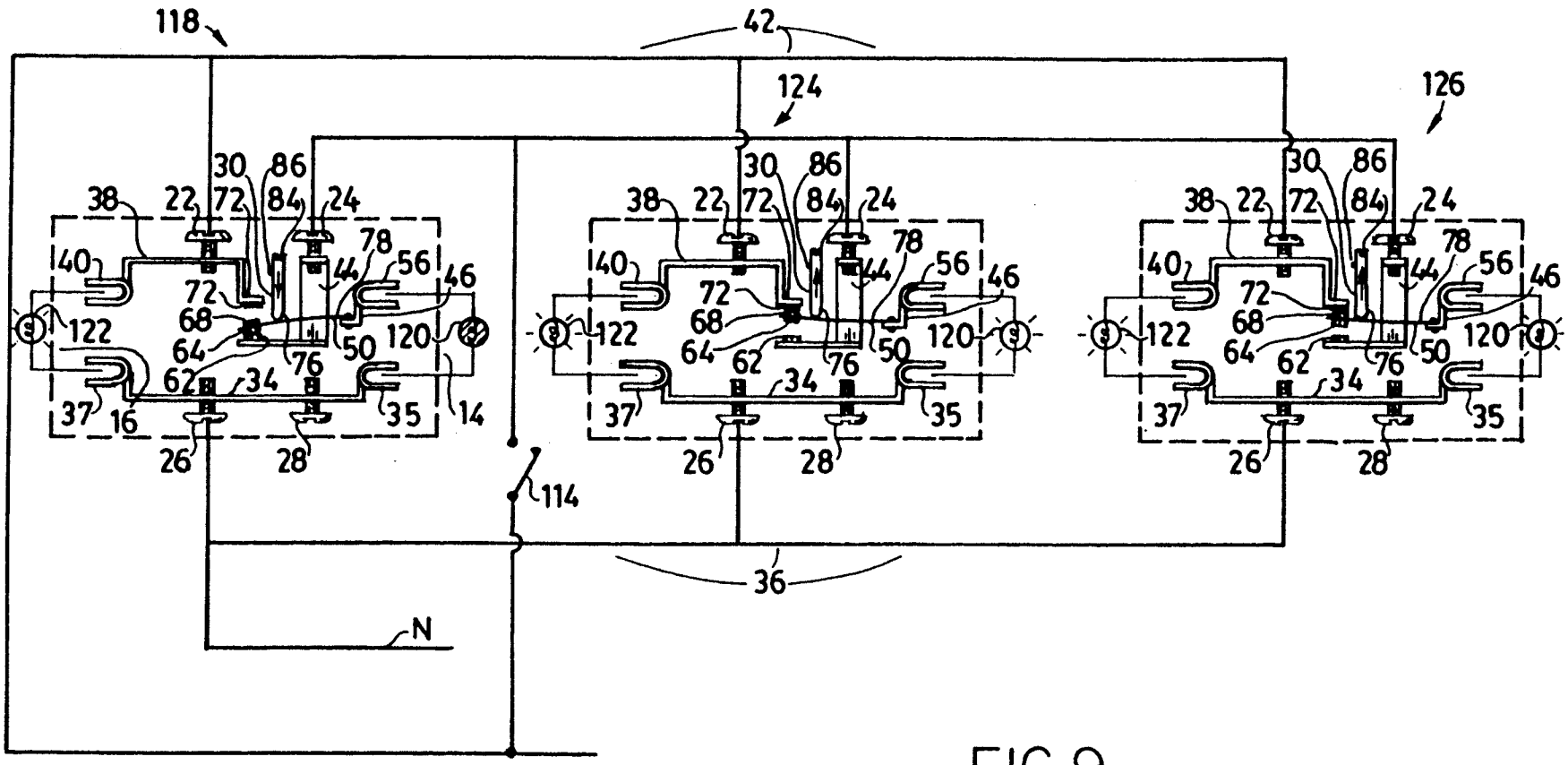

FIGS. 8 and 9 are wiring diagrams illustrating the flexibility which receptacle 10 allows one. In each of these wiring diagrams, the neutral side of the circuit is side 36, and the positive side of the circuit is side 42.

Referring to FIG. 8, it will be seen that the circuit 100 provides direct, positive, constant hot power to each of terminal screws 22 via line 102, 104, and 106, respectively. The negative end of the circuit is connected to terminal screws 26 via lines 108, 110, and 112, respectively. Positive, constant hot power is also provided to switch via line 116.

In receptacles 118 and 126, where rod 30 is in its up position, both receptacles 14 and 16 are directly connected to the positive, constant hot line and, thus, cause lamps 120 and 122 to light, even when switch 114 is open.

In receptacle 124, when rod 30 is in its down position, receptacle 16 is still directly connected to the positive, constant hot line and, thus, will cause lamp 122 to light. However, receptacle 14 is now connected to the constant hot line via switch 114 which, because it is open, cuts the flow of power to lamp 120.

FIG. 9 shows a circuit similar to that of FIG. 8, with the exception that rod 30 is in a different position for each of receptacles 118 and 124 than it is in FIG. 8.

Thus, in FIG. 9, the rod 30 is in the down position in receptacle 118, causing plug 14 to be connected through switch 114 to the constant how power line. Because switch 114 is open, lamp 120 is not lit.

Thus, in FIG. 9, the rod 30 is in the up position in receptacles 124. This receptacle is now connected in the manner of receptacle 118 of FIG. 8, and thus both lamps 120 and 122 are lit.

Figure 10:
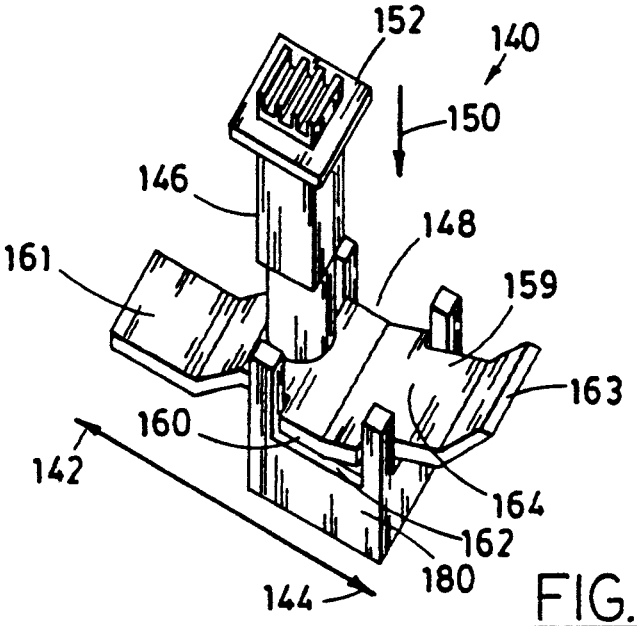
FIG. 10 is a perspective view of one preferred embodiment of switch which may be used in the receptacle of this invention.
Figure 13:
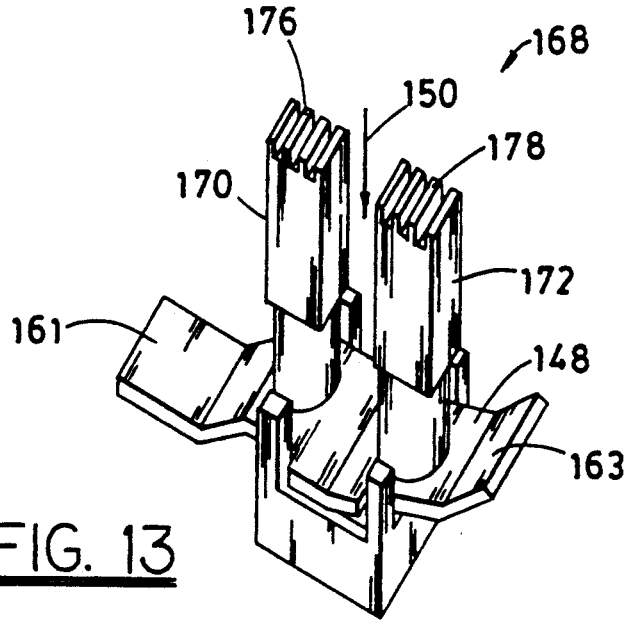
FIG. 13 is a perspective view of another preferred embodiment of a switch which may be used in the receptacle of this invention.

The novel switch used in the receptacle of this invention is illustrated in FIGS. 10 and 13. The receptacle of this invention may utilize a similar bus bar structure (comprising a first integral electrical contact, a second integral electrical contact, a third integral electrical contact, and a fourth integral electrical contact) as is utilized in the receptacle of U.S. Pat. No. 5,098,307. The receptacles of this invention may utilize exactly the same first female receptacle and the second female receptacle as is utilized in the device of U.S. Pat. No. 5,098,307. However, the receptacle of this invention preferably utilizes a linearly movable switch which, when moved in either the X axis of the Y axis, makes contact with either one of said bus bars, or another of said bus bars.

Referring to FIG. 10, a preferred switch 140 is illustrated. This switch 140 may be manually moved in the X axis in the direction of either arrow 142 or arrow 144.

Referring again to FIG. 10, it will be seen that switch 140 is comprised of spring loaded pin 146 which is connected to plate 148. In the operation of switch 140, plate 148 is pressed down in the direction of arrow 150 because of the spring-loaded nature of pin 146.

Figure 11:
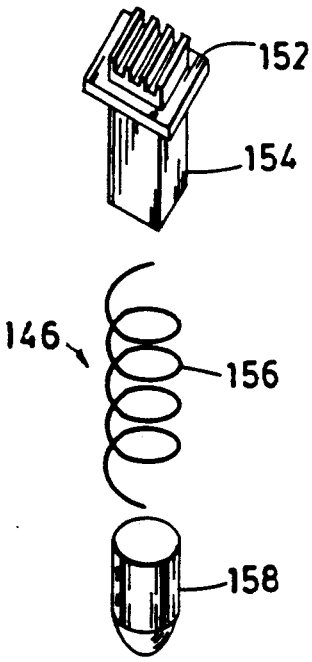
FIG. 11 is an exploded view of the button used in the switch of FIG. 10.

One preferred embodiment of spring-loaded pin 146 is illustrated in FIG. 11. Referring to FIG. 11, it will be seen that pin 146 is comprised of top surface 152, chamber 154, a spring 156 disposed within said chamber, and a pin contact 158 which is contiguous with plate 148 (not shown in FIG. 11).

Although pin contact 158 is contiguous with plate 148, it is not attached to such plate. Thus, when top surface 152 is pulled or pushed in the direction of arrows 142 or 144, , pin contact 158 is free to move over the top surface 159 of plate 148. As it moves over such surface, it exerts downward pressure upon such plate.

Because of this spring-loaded mechanism, whenever spring-loaded pin 146 is moved in the direction of either arrow 142 or arrow 144, pressure is applied to plate 148 in the direction of arrow 150. When spring-loaded pin 146 is in the position depicted in FIG. 10, it will tend to push plate contact 161 downwardly and to tend to cause it to contact with a bus (not shown). When spring-loaded pin 146 is moved so that pin contact 158 is contiguous with point 164 ofplate 148, it will tend to push plate contact 163 downwardly and to tend to cause it to contact with a bus (not shown).

It will be apparent to those skilled in the art that other means of applying pressure to plate 148 in the direction of arrow 150 may be used instead of spring-loaded pin 146.

Figure 12:
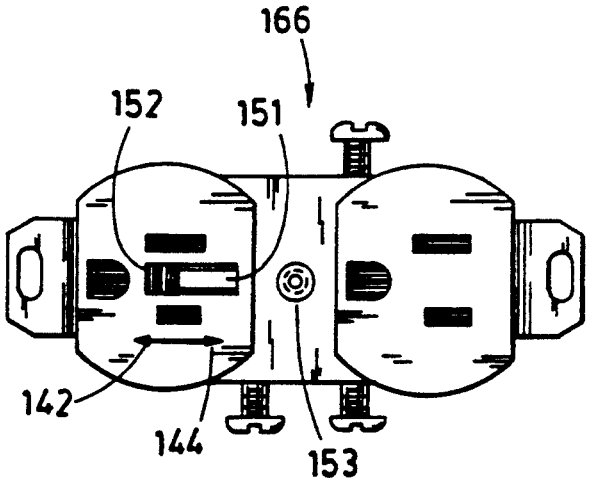
FIG. 12 is a top view of a receptacle which preferably is comprised of the switch of FIG. 10.

The mechanism illustrated in FIGS. 10 and 11 is preferably incorporated into the receptacle 166 depicted in FIG. 11. Referring to FIG. 11, it will be seen that receptacle 166 is comprised of an orifice 151 through which at the top surface 152 of spring loaded pin 140 at least partially extends. Top surface 152 may be manually moved in the directions of arrows 142 and 144, thereby depressing either plate contact 161 or 163 (not shown in FIG. 12).

As will be apparent to those skilled in the art, orifice 151 and/or top surface 152 may be located in other portions of receptacle 166; thus top surface 152 may be located in section 153, or in substantially any other portion of the receptacle 166. Furthermore, the same mechanism may be used with other receptacles, such as decor receptacles.

FIG. 13 illustrates another preferred embodiment in which switch is comprised of a first pushbutton 170 and a second pushbutton 172. Pushbuttons 170 and 172 may be spring-loaded (as is the device of FIG. 11), but they need not be.

In the embodiment illustrated in FIG. 13, when pushbutton 170 is depressed in the direction of arrow 150, plate contact 161 is depressed. When pushbutton 172 is depressed in the direction of arrow 150, plate contact 163 is de- pressed. Thus, the device of FIG. 13 can be made to function in a manner similar to that of the device of FIG. 10.

Figure 14:
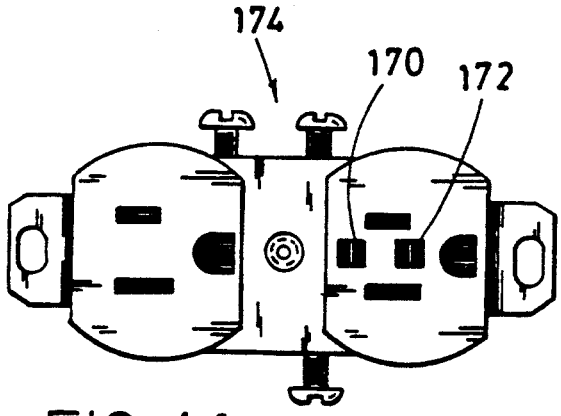
FIG. 14 is to view of a receptacle comprised of the switch of FIG. 13.

FIG. 14 illustrates a receptacle 174 comprised of the switch mechanism 168 of FIG. 13. Referring to FIG. 14, it will be seen that, in this embodiment, the top surface of the receptacle 174 is comprised of two orifices (not shown) through which the top surfaces 176 and 178 of pushbuttons 170 and 172 extend. As is true with the embodiment illustrated in FIGS. 10, 11, and 12, the orifices and the push buttons 170 and 172 may be located at other portions of the receptacle 174. Furthermore, this arrangement may be used with receptacles other than those shown in FIGS. 12 and 14.

Figure 15:
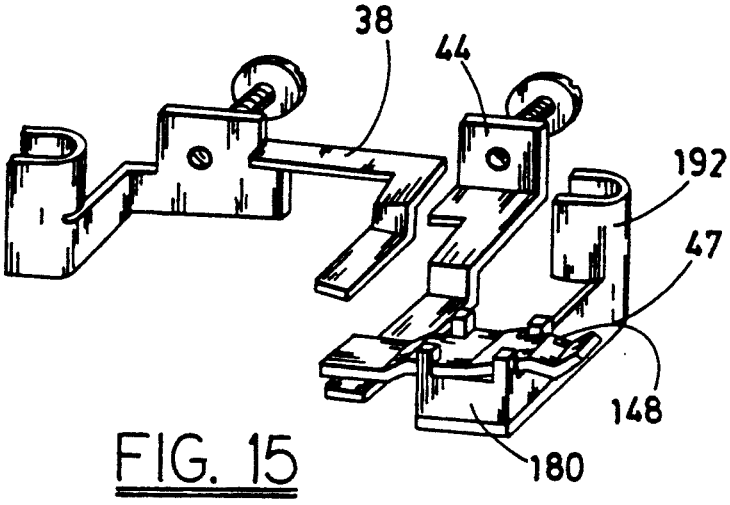
FIG. 15 is an exposed view of the bus bars used in the receptacle of FIG. 14.

FIG. 15 illustrates a preferred embodiment in which plate 148 is supported by the a cradle 180 formed in the end of conductor bus 47. It will be seen that receptacle 174 is comprised of terminals 191, 192, 193, and 195, contact assembly 197, contact plates 194, 196, and 161, and top and bottom surfaces 199 and 201 of plate 161. Referring to FIG. 15, and to similar FIG. 5, the following similarities and differences should be noted: (1)both structures utilize a conductor bus 38 (or a conductor bus of similar structure), (2)both structures utilize a conductor bus 44 (or a conductor bus of similar structure), (3) the movable plate 50 which is attached to the conductor bus 46 of the device of FIG. 5 is not used in the device of FIG. 15, (4)the cradle 180 which is used in the device of FIG. 15 is not used in the device of FIG. 5, and (5)the movable plate 148 which is used in the device of FIG. 15 is not used in the device of FIG. 5.

For the sake of simplicity, means for moving plate 148 downwardly are not illustrated in FIG. 15. It will be readily apparent to those skilled in the art that the means depicted in FIGS. 10 and/or 13 may be used to move such plate downwardly. Other such means also will be apparent to those skilled in the art.

In the embodiment illustrated in FIG. 15, each of the elements used is preferably substantially rigid, and a change in the contacts made between the elements is effectuated by the movement of such substantially rigid element rather than by its flexure.

As will be apparent to those skilled in the art, one may use other means of pressing downwardly (or pulling upwardly) upon a plate so that it makes or breaks contact with a conductor bus. Thus, by way of further illustration, one such means is illustrated in FIGS. 15A and 15B.

Figure 15A:
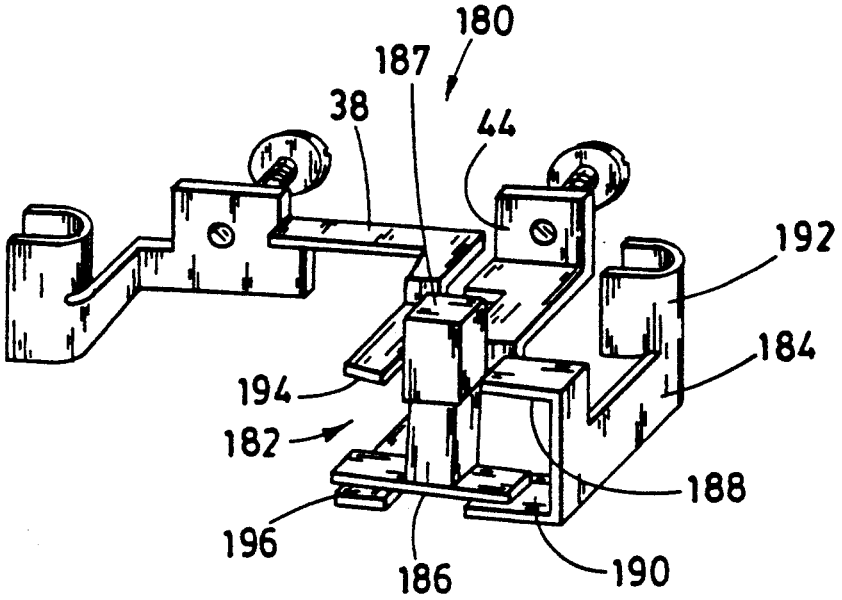
FIG. 15A is a perspective view of one preferred receptacle with several of its parts omitted for the sake of clarity.
Figure 15B:
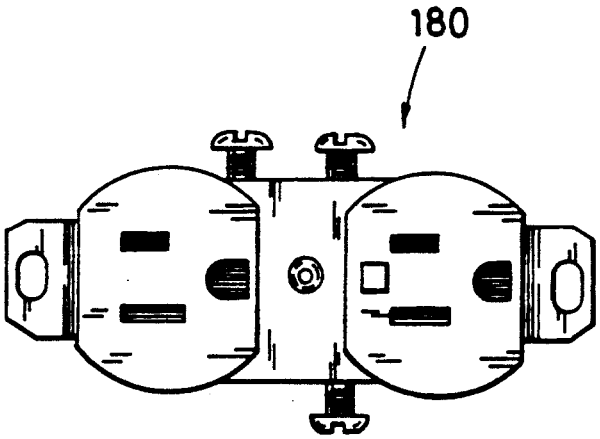
FIG. 15B is a top view of of one preferred receptacle which contains a switching means similar to the switching means employed in the receptacle depicted in FIG. 15A.

Referring to FIG. 15A, a receptacle is shown with several of its parts omitted for the sake of clarity. The receptacle is comprised of movable connector 182, conductor bus 38, conductor bus 44, and conductor bus 184.

The movable connector 182 is comprised of a movable plate 186 and, connected thereto, a button 187.

Conductor bus 184 is constructed so that it is comprised of an upper contact plate 188 and a lower contact plate 190 at one end thereof; as will be apparent to those skilled in the art, both of contact plates 188 and 190 are electrically connected to the same terminal 192.

Conductor bus 184 is so disposed that its upper contact plate 188 is substantially aligned with the upper contact plate 194 of conductor bus 38, and its lower contact plate 190 is substantially aligned with the lower contact plate 196 of conductor bus 44.

As will be apparent to those skilled in the art, when plate 186 is contiguous with plates 190 and 196, current carries through conductor bus 44. When plate 186 is contiguous with plates 194 and 188, current carries through conductor bus 38.

Any means may be used to movably dispose movable connector 182 between plates 194 and 196, and 188 and 190. Thus, in one embodiment, not shown, a spring mechanism is used to bias connector 182 so that it normally abuts plates 194 and 188 and must be depressed to contact plates 196 and 190. In another embodiment, not shown, movable connector 182 is comprised of first locking means for locking it into abutment with plates 188 and 194, means for removing the contact between connector 182 and plates 188 and 194, means for locking connector 182 into abutment with plates 190 and 196, and means for removing the contact between plates 190 and 196 and connector 182. Such locking and unlocking means are well known to those skilled in the art.

FIG. 15B illustrates a receptacle 180 comprised of the switching means 182. Referring to FIG. 15B, it will be seen that receptacle 180 is comprised of an orifice (not shown) through which button 187 extends. When button 187 is pushed downwardly, it breaks contact with one of the connector buses and makes contact with another of the connector busses.

As is apparent to those skilled in the art, the orifice and the button 187 may be located on different portions of receptacle 180 and/or may be used with different receptacles. Furthermore, it will also be apparent that other designs or mechanisms in which a movable plate is normally biased against one connector but may be moved into contact with another connector are within the scope of this invention.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. An adjustable duplex receptacle comprised of:

(a)a body comprised of a first female receptacle and a second female receptacle wherein:

1. each of said first female receptacle and said second female receptacle is comprised of two orifices which each has a substantially rectuangular cross-sectional shape,
2. said body is comprised of a central orifice, and
3. said body is comprised of a first mounting bracket and a second mounting bracket;

(b) a first integral electrical contact, a second integral electrical contact, a third, integral electrical contact, wherein said first integral electrical contact, said second integral electrical contact, and said third integral electrical contact are located within said body, and: wherein:

1. said first, integral electrical contact is comprised of a first terminal, a first terminal screw, and a first contact plate;
2. said second, integral contact is comprised of a second terminal, a second terminal screw, and a second contact plate;
3. said third, integral contact is comprised of a proximal end, a distal end, a third terminal, and a contact assembly with an electrically conductive surface, wherein:
   (a)said third terminal is located at the distal end of said integral contact, and said contact assembly is located at the proximal end of said contact assembly;
   (b)said contact assembly is comprised of a first contact surface, and a second contact surface;

(c)a movable connector disposed within said body, wherein said movable connector engages said electrically conductive surface of said contact assembly;

(d)moving means for moving said movable connector in a first direction within said body to cause said movable connector to abut said first contact plate; and (e) means for moving said movable connector in a second direction within said body to cause said electrically conductive plate to move out of abutment with first contact plate and into contact with said second contact plate, whereby the movable connector is used to selectively electrically connect said electrically conductive surface to either one or the other of the first and second contact plates.

2. The duplex receptacles as recited in claim 1, wherein said first direction is vertically downward and said second direction is vertically upward.

3. The duplex receptacle as recited in claim 1, wherein said first direction is vertically upward and said second direction is vertically downward.

4. The duplex receptacle as recited in claim 2, wherein said electrically conductive surface is comprised of a center section and, integrally joined therewith, a first end and a second end.

5. The duplex receptacle as recited in claim 4, wherein said first end and said second end do not lie in the same plane.

6. The duplex receptacle as recited in claim 5 wherein, when said shaft is moved towards said first end, it causes said first end to move downwardly and said second end to move upwardly.

7. The duplex receptacle as recited in claim 6, wherein, when said shaft is moved towards said second end, it causes said second end to move downwardly and said first end to move upwardly.

8. The duplex receptacle as recited in claim 7, wherein said movable connector is a spring-loaded connector.

* * * * *